US008480091B1

(12) United States Patent
Florence

(10) Patent No.: US 8,480,091 B1
(45) Date of Patent: Jul. 9, 2013

(54) GAMING TABLE WITH INTERCHANGEABLE LAYOUTS

(76) Inventor: William H. Florence, Shepherdstown, WV (US)

( * ) Notice: Subject to any disclaimer, the term of this patent is extended or adjusted under 35 U.S.C. 154(b) by 463 days.

(21) Appl. No.: 12/653,095

(22) Filed: Dec. 8, 2009

(51) Int. Cl.
*A63F 9/00* (2006.01)

(52) U.S. Cl.
USPC ..... 273/309

(58) Field of Classification Search
USPC ..... 273/309
See application file for complete search history.

(56) References Cited

U.S. PATENT DOCUMENTS

| | | | | |
|---|---|---|---|---|
| 908,752 | A * | 1/1909 | Conrwall | 473/8 |
| 919,708 | A * | 4/1909 | Francis | 273/309 |
| 1,886,806 | A * | 11/1932 | Hanley | 108/90 |
| 3,001,843 | A * | 9/1961 | Davis | 108/62 |
| 3,583,337 | A * | 6/1971 | Yokeley | 108/90 |
| D223,265 | S * | 4/1972 | Wolf | D21/342 |
| 3,884,469 | A * | 5/1975 | Morton | 273/108.21 |
| 4,015,778 | A * | 4/1977 | Chen et al. | 273/284 |
| 4,614,342 | A * | 9/1986 | Takashima | 463/11 |
| 4,813,675 | A * | 3/1989 | Greenwood | 463/46 |
| 5,133,559 | A * | 7/1992 | Page | 273/274 |
| 5,630,760 | A * | 5/1997 | Brown et al. | 273/108.52 |
| 6,074,720 | A | 6/2000 | Van Stratum | |
| 6,220,598 | B1 | 4/2001 | Kweitko et al. | |
| 6,270,404 | B2 * | 8/2001 | Sines et al. | 463/12 |
| 6,367,392 | B2 * | 4/2002 | Moore | 108/90 |
| 6,945,533 | B1 | 9/2005 | Salerno | |
| 7,472,909 | B1 * | 1/2009 | Gordon | 273/309 |
| 2002/0073901 | A1 * | 6/2002 | Arnell | 108/90 |
| 2002/0084587 | A1 | 7/2002 | Bennett et al. | |
| 2004/0160005 | A1 | 8/2004 | Krise et al. | |
| 2005/0236771 | A1 | 10/2005 | Soltys et al. | |
| 2010/0222148 | A1 * | 9/2010 | Kuhn et al. | 463/46 |

FOREIGN PATENT DOCUMENTS

WO WO 01/87438 A2 11/2001

OTHER PUBLICATIONS ttp://www.google.com/....5.1.396.4708.13j15j3j2.33.0...0.0...1c.wj3oZ3YwkN8&pbx=1&bav=on.2,or.r_gc.r_pw.r_qf.&fp=d3ac3099e727d1f3&biw=1280&bih=740[Jul. 30, 2012 2:14:21 PM].*

* cited by examiner

*Primary Examiner* — Kurt Fernstrom
*Assistant Examiner* — Dolores Collins
(74) *Attorney, Agent, or Firm* — Norman E. Lehrer

(57) ABSTRACT

A casino gaming table having interchangeable layouts includes a table base and a planar tabletop supported on the base. The tabletop has an upper surface and a peripheral edge, at least a portion of which is arcuately shaped. An arcuately shaped rail is mounted to the tabletop adjacent the arcuately shaped peripheral edge but is spaced from the upper surface of the table. A plurality of game layout pads are provided with arcuate peripheral edges. The pads are adapted to rest on the tabletop with their arcuate peripheral edges fitting under the rail in the space between the rail and the table surface. The game layout pads are rigid enough to substantially maintain their planar shape when being moved into and out of position but can be flexed in order to insert their arcuate peripheral edges into the space between said lower surface of the rail and the upper surface of the tabletop. Three pads with a different game on each can be accommodated on the table with their peripheral edges fitting within the space between the rail and the tabletop.

4 Claims, 5 Drawing Sheets

GAMING TABLE WITH INTERCHANGEABLE LAYOUTS

BACKGROUND OF THE INVENTION

The present invention is directed toward a gaming table and more particularly, toward a gaming table with interchangeable layouts that allows the game played on the gaming table to be easily and quickly changed to a different game without having to remove the table from the casino gaming floor.

Currently, layouts made from felt, foam, velvet, or the like cloth material are used on gaming tables found in casinos. The layout has indicia printed thereon for a particular game such as Blackjack, Three Card Poker, Mini Baccarat and numerous others which will include betting areas, odds, payoff schedules, side bets and the like. The layout also frequently contains advertisements and other indicia printed thereon such as the name of the casino, special promotions and substantially any other information that the casino may wish to print.

Typically, the layout is stapled or otherwise secured to a rigid board that forms the upper surface of the gaming table. If it is desired to change the game being played on the table or if the layout becomes worn, the felt or other material must be removed and replaced. In most known prior art methods for replacing a gaming layout, the game must be shut down and the entire table moved off the floor and into a workroom for replacement.

One known prior art method for removing and replacing a gaming layout on a gaming table is illustrated in FIGS. 7-9 of Published International Application No. WO 01/87438. As illustrated therein, in order to remove a layout from the top of a table, the rail or sidewalls of the table which are secured to the top, must be removed. The fabric layout had been stapled or otherwise secured to the edges along the back or underside of the tabletop. The layout is removed from the underside means of a razor or knife. The staples are then removed so that the board is free of the original layout which is now unusable and is discarded.

A replacement layout fabric having the desired indicia printed on its front side is then spread out on the tabletop so that the outer edges of the layout may be stapled onto the underside of the tabletop. The rail is then put back into place and secured to the tabletop and table. This is a time-consuming and labor-intensive procedure.

U.S. Pat. No. 5,133,559 to Page discloses a traditional layout for a gaming table. The layout includes various indicia for identifying various dice odds, betting areas, etc. The indicia on the layout help novices to understand the game of craps. The layout is made from a flexible thin sheet of plastic, foam, velvet, or felt and may be placed or mounted on the horizontal top of a gaming table. However, this layout may not be easily removed and replaced.

Published International Application No. WO 01/87438 referred to above discloses an improvement which allows for quicker removal and replacement of a gaming layout. The invention disclosed therein includes a pad comprised of layout that is printed on a fabric which, in turn, is adhered to a foam backing similar to the material from which mouse pads are constructed. The layout pad is cut to the specific size to fit a particular gaming table.

When it is desired to change the game being played on a gaming table or if it otherwise becomes necessary to replace the layout, the rail or sidewalls of the table are unscrewed from the bottom, the old layout pad is removed and the new layout pad is placed in position on the tabletop. The rails or sidewalls, which fit over the outer edge of the new layout pad, are then secured back onto the tabletop to hold the new layout pad in place.

While the invention disclosed in the International Application is an improvement on prior systems, it still requires that the game be shut down for a substantial period of time. The table must be brought to a work area or a laborer must bring a new layout pad to the gaming floor, remove the rail, replace the pad and then replace the rail.

In U.S. Pat. No. 4,813,675 it is suggested to place a game layout board on top of the glass of a video game machine. This converts a video gaming machine into a standard casino gaming table. The invention disclosed in this patent, however, still requires that a worker bring a game board or layout pad from a storage area to the gaming table. In addition, there is nothing disclosed for holding the layout pad in place and it could, therefore, easily become dislodged. Even further, a drink or other liquid accidentally spilled on the layout could drip down onto the video game causing damage to the same.

A need exists in the industry for a system for changing a layout for a casino gaming table which can be done easily and quickly without have to bring a new layout to the table and which minimizes the amount of time that the game must be shut down.

SUMMARY OF THE INVENTION

The present invention is designed to overcome the deficiencies of the prior art discussed above. It is an object of the present invention to provide a simple and quick way to replace the game layout of a gaming table.

It is another object of the present invention to provide a gaming table wherein the game being played thereon can be changed easily and quickly.

It is still another object of the present invention to provide a gaming table wherein the game being played thereon can be changed without have to remove the table from the gaming floor.

It is and even further object of the present invention to provide a gaming table wherein the game being played thereon can be changed without the use of tools or skilled labor.

In accordance with the illustrative embodiments demonstrating features and advantages of the present invention, there is provided a casino gaming table having interchangeable layouts which includes a table base and a planar tabletop supported on the base. The tabletop has an upper surface and a peripheral edge, at least a portion of which is arcuately shaped. An arcuately shaped rail is mounted to the tabletop adjacent the arcuately shaped peripheral edge but is spaced from the upper surface of the table. A plurality of game layout pads are provided with arcuate peripheral edges. The pads are adapted to rest on the tabletop with their arcuate peripheral edges fitting under the rail in the space between the rail and the table surface. The game layout pads are rigid enough to substantially maintain their planar shape when being moved into and out of position but can be flexed in order to insert their arcuate peripheral edges into the space between said lower surface of the rail and the upper surface of the tabletop. Three pads with a different game on each can be accommodated on the table with their peripheral edges fitting within the space between the rail and the tabletop. To change the game being played on the table, all that is necessary is to lift the top pad off and interchange it with one of the two pads below the top pad.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings a form which is presently preferred; it being understood that the invention is not intended to be limited to the precise arrangements and instrumentalities shown.

DETAILED DESCRIPTION OF THE PREFERRED EMBODIMENT

Figure 1:
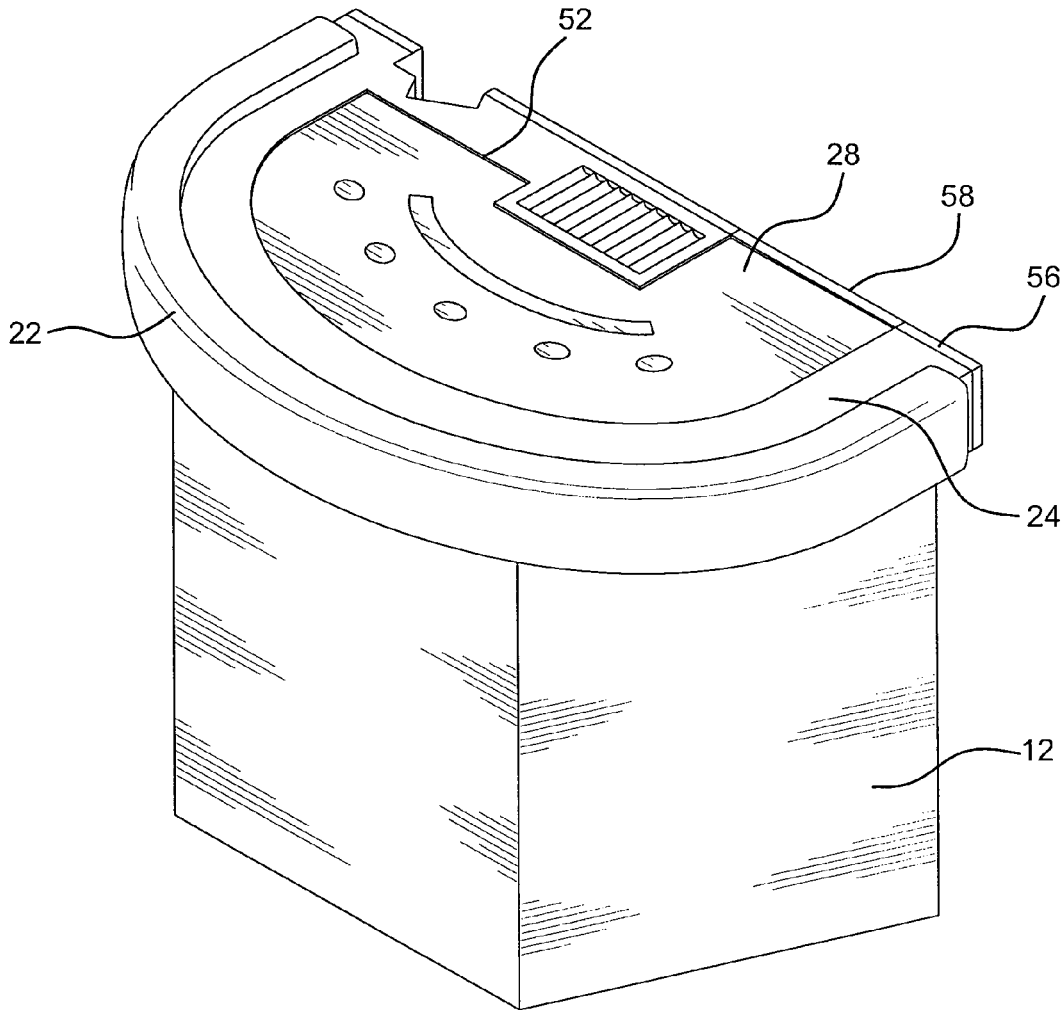
FIG. 1 is a top rear perspective view of a gaming table of the present invention.

Referring now to the drawings in detail wherein like reference numerals have been used throughout the various figures to designate like elements, there is shown in FIG. 1 a gaming table with interchangeable layouts constructed in accordance with the principles of the present invention and designated generally as 10.

The gaming table 10 with interchangeable layouts of the present invention essentially includes a table base 12 and a planar tabletop 14 supported on the table base 12. The tabletop has an upper surface 16 and a peripheral edge 18. At least a portion of the peripheral edge of the tabletop 14 is arcuately shaped.

Figure 4:
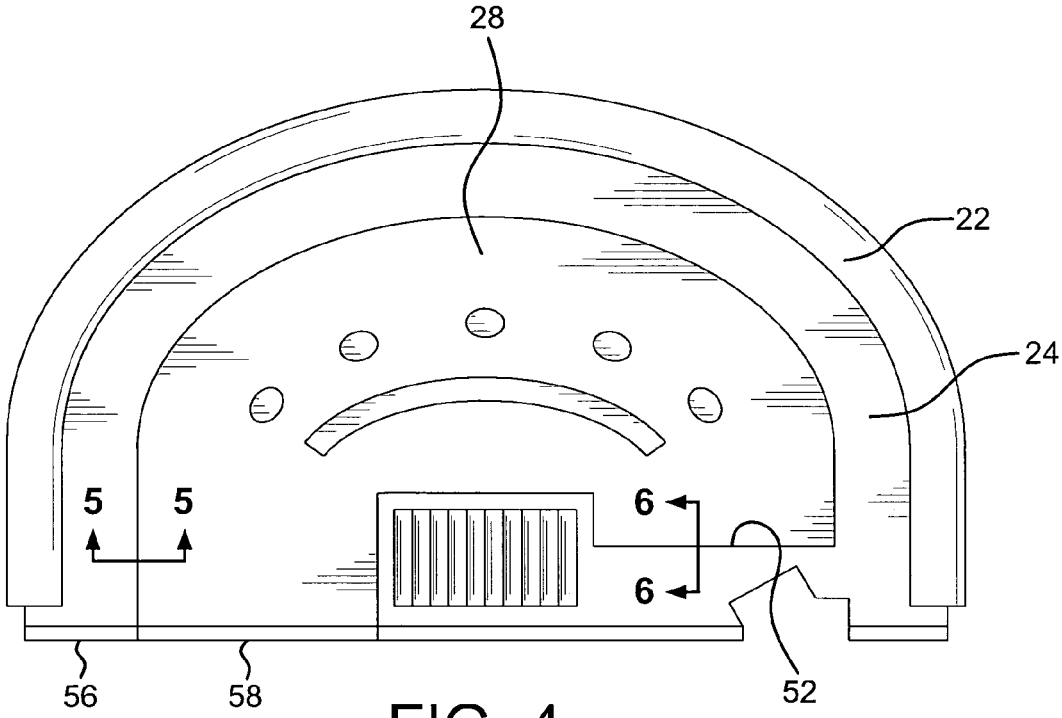
FIG. 4 is a top plan view of the gaming table of FIG. 1.

In the preferred embodiments of the invention, the arc formed by the peripheral edge of the tabletop 14 is approximately 180°. Furthermore, it need not be exactly arcuate but could have longitudinal portions such as shown most clearly in FIG. 4. For convenience, however, and with the exception of the rear vertical linear wall 20 of the tabletop, the peripheral edge will be referred to as arcuate.

As is known in the art, an arcuately shaped side wall or rail surrounds the arcuately shaped peripheral edge 18 of the table 14. In the embodiment shown, the rail is formed of two parts. An outer padded rail 22 and a more rigid inner rail 24. It should be readily apparent, however, that these two rails could be formed of one piece. Furthermore, and as will become apparent, the invention could be practiced using only one of the two rails 22 or 24.

Figure 5:
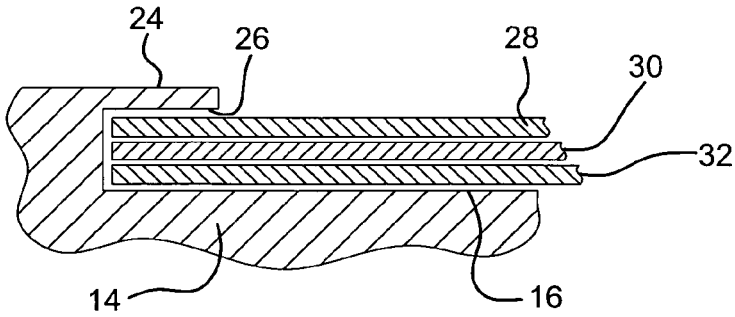
FIG. 5 is a cross-sectional view taken through line 5-5 of FIG. 4.
Figure 6:
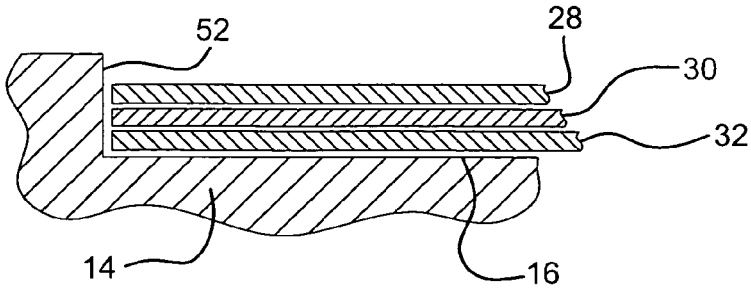
FIG. 6 is a cross-sectional view taken through line 6-6 of FIG. 4.

As shown most clearly in FIG. 5, the rail 24 has a lower surface 26 which overlies a portion of the upper surface 16 of the tabletop 14 but is spaced therefrom by a fixed distance thereby leaving a space between the lower surface 26 of the rail 24 and the upper surface 16 of the tabletop 14.

The casino gaming table 10 of the present invention also includes a plurality of game layout pads 28, 30 and 32. Each of these game layout pads is shaped essentially the same as the shape of the upper surface 16 of the tabletop 14. Each layout pad includes a fabric surface with game indicia printed thereon which is secured to a flat planar backing. This can be done in any known conventional manner such as by gluing the back of the fabric to the face of the backing or wrapping the fabric around to the reverse side of the backing and stapling or otherwise adhering it thereto. It is also not beyond the scope of the present invention to simply print the game layout directly on the planar backing board or the like.

Figure 7:
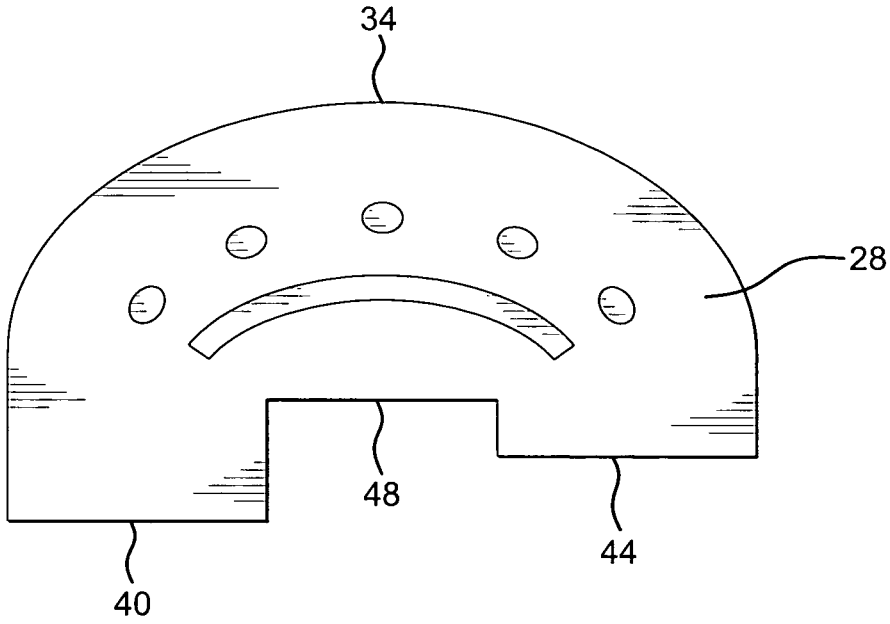
FIG. 7 is a top plan view of a layout having a first type of casino game thereon.
Figure 8:
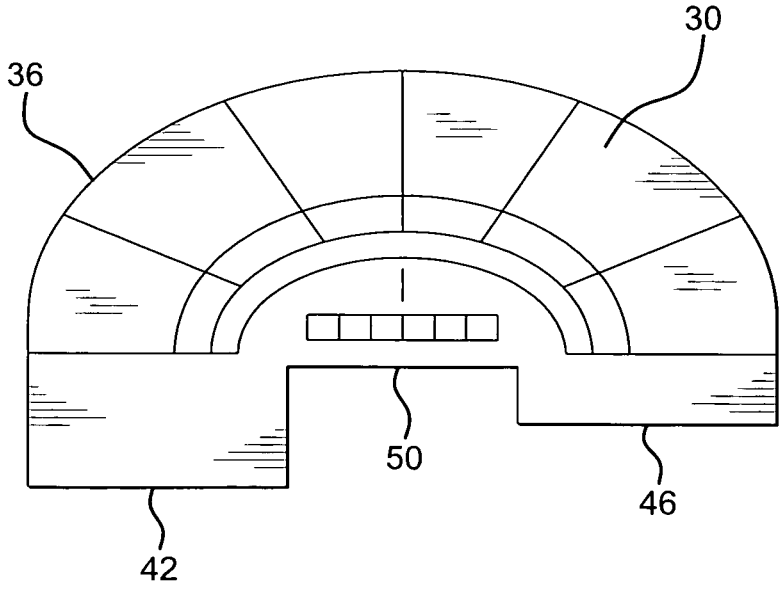
FIG. 8 is a top plan view of a layout having a second type of casino game thereon.

In any event, each of the layout pads 28, 30 and 32 includes an arcuate peripheral edge such as shown at 34 and 36 in FIGS. 7 and 8. As pointed out above, each of the layout pads 28, 30 and 32 is complementary in shape to the upper surface 16 of the tabletop 14 and are adapted to rest thereon. When properly placed, the arcuate peripheral edges 34, 36 and 38 of the three pads 28, 30 and 32 lie within the space between the lower surface 26 of the rail 24 and the upper surface 16 of the tabletop 14. This is shown most clearly in FIGS. 5 and 9.

The foregoing is, of course, by way of example only. In the preferred embodiment of the invention, three game layout pads 28, 30 and 32 are utilized. However, the invention could also be used with two layout pads or with more than three layout pads. It has been found, however, that the optimal number is three.

Figure 3:
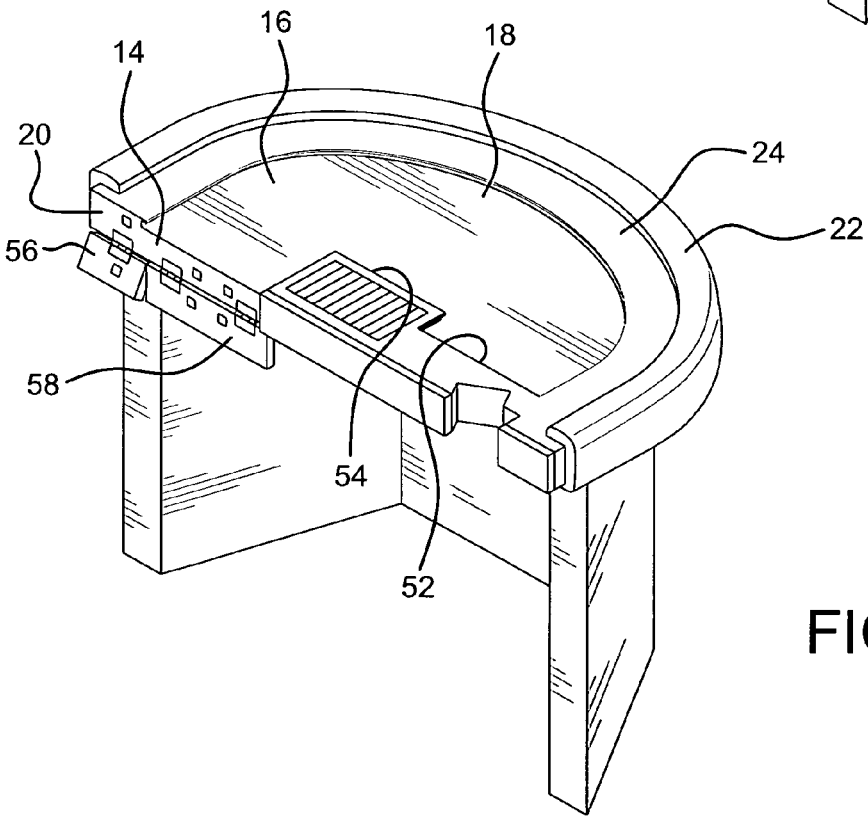
FIG. 3 is a view similar to FIG. 1 but illustrating how the rear of the table opens to accommodate the replacement of a layout.
Figure 9:
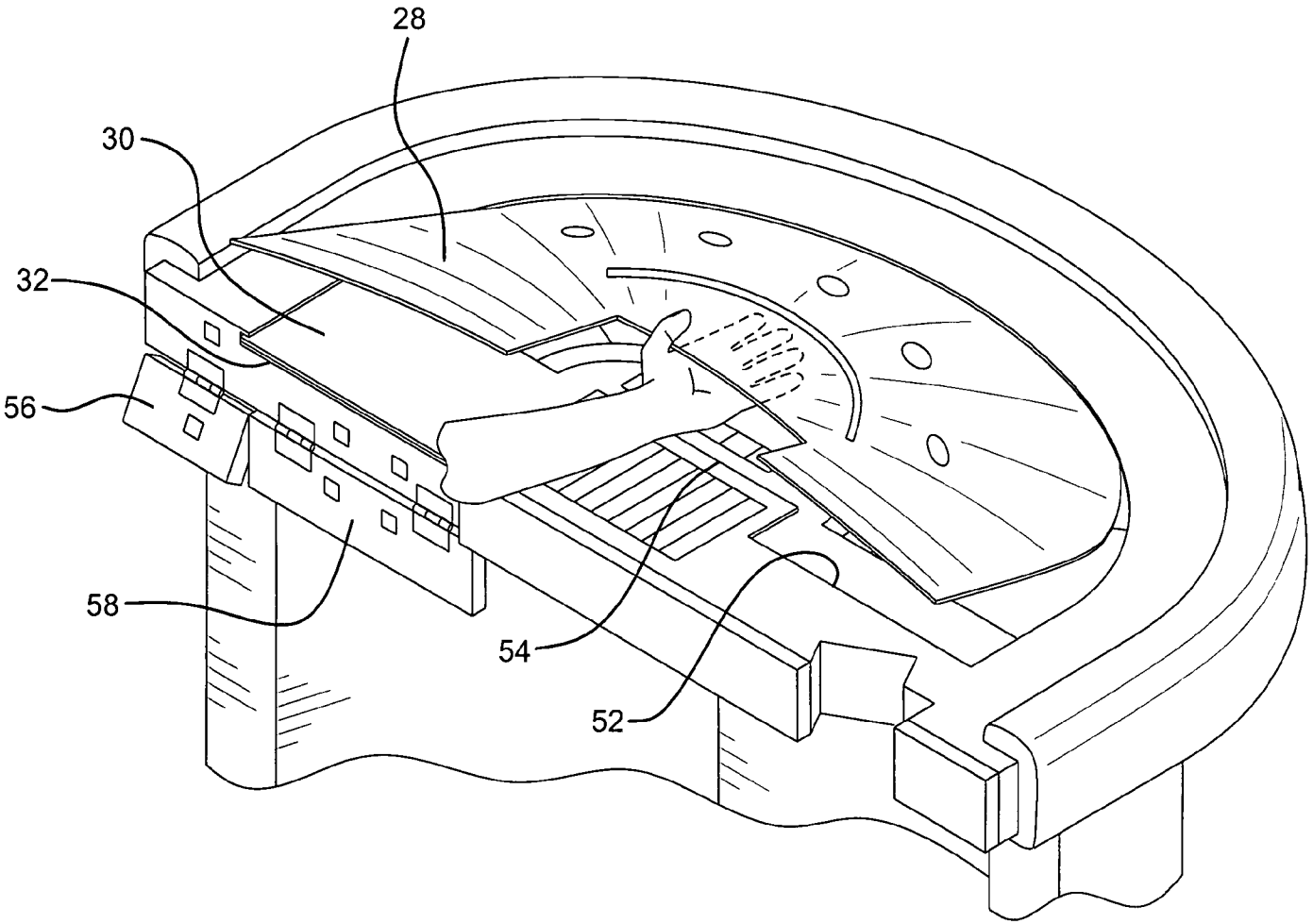
FIG. 9 is a perspective view illustrating how the layouts of the present invention are exchanged.

As best shown in FIGS. 3 and 9, the rear wall 20 of the tabletop 14 is linear and vertical. Each of the game layout pads 28, 30 and 32 includes a straight edge such as shown at 40 and 42. (See FIGS. 7 and 8) The straight edges 40 and 42 are complementary to and are the size so as to be in alignment with the vertical wall 20 as best shown in FIG. 9.

Each of the game layout pads 28, 30 and 32 also includes a linear portion such as shown at 44 and 46 in FIGS. 7 and 8 and a cutout portion such as shown at 48 and 50 in the same figures. The linear portions 44 and 46 and the cutout portions 48 and 50 are intended to fit against and align with the complementary portions 52 and 54 of the tabletop 14.

To facilitate the removal of one of the three game layout pads and/or the insertion of one of the pads, the rear wall 20 of the tabletop 14 includes hinged wall portions 56 and 58. These hinged wall portions 56 and 58 are movable between an operative position as shown most clearly in FIG. 2 where they extend vertically above the upper surface 16 of the tabletop 14 to inoperative position such as shown in FIGS. 3 and 9 wherein they lie below the surface 16.

Figure 2:
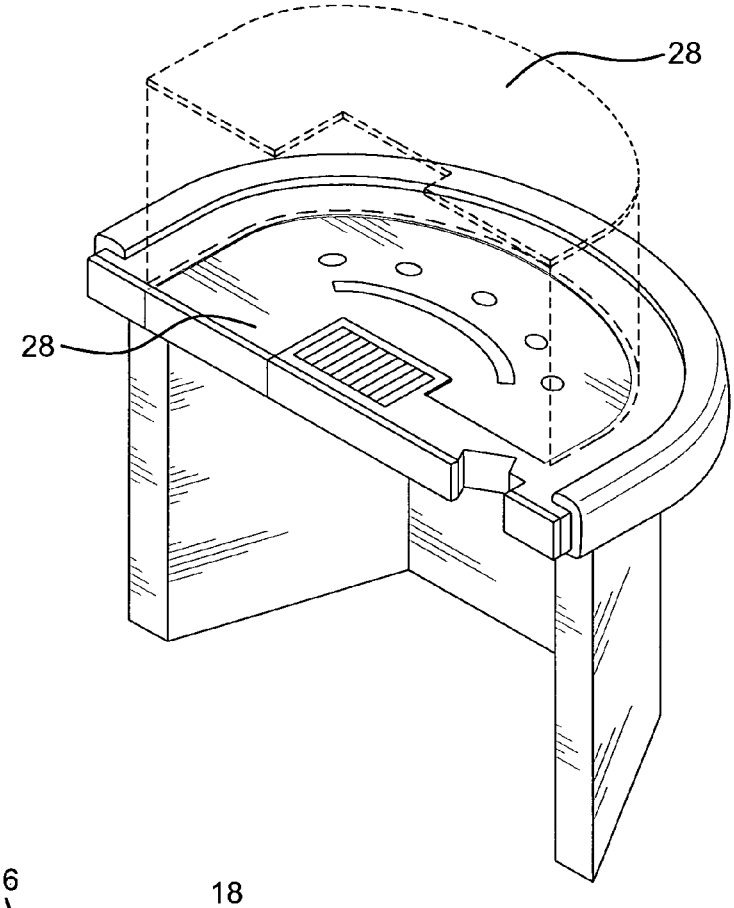
FIG. 2 is an exploded view similar to FIG. 1 showing the layout exploded above the table.

As shown most clearly in FIG. 9, the game layout pads such as shown at 28 are rigid enough to substantially maintain their planar shape when being manipulated but can be flexed. As shown, the game layout pad 28 can be flexed in order to insert the arcuate edge 34 thereof into the space between the lower surface 26 of the rail 24 and the upper surface 16 of the tabletop 14. To aid in the manipulation and insertion or removal of one of the layout pads, the hinged walls 56 and 58 are first lowered into their inoperative position. Once the layout pad is in place, the hinged walls 56 and 58 can be raised into the operative position such as shown in FIGS. 1 and 2.

Each of the game layout pads 28, 30 and 32 can have the same casino game indicia printed thereon or they could have different indicia. For example, the game layout pad 28 shown in FIG. 7 could be used for playing Blackjack while the game layout pad 30 shown in FIG. 8 could be used to play a variation of the game of poker.

If different indicia are printed on the game layout pads, the game being played at the table can be changed whenever desired by simply lowering the hinged walls 56 and 58, lifting out the uppermost game pad 28 and any other desired game pad, interchanging them with the desired game pad on top and reinserting them in the manner illustrated in FIG. 9. Thereafter, the hinged walls 56 and 58 are pivoted up into their operative positions. This change can be done within a few minutes by substantially any employee without any special skills and can be done without having to remove the table from the gaming floor.

Even if it were not desired to change the game being played on the table, the invention has other uses. That is, each of the game layout pads 28, 30 and 32 could be identical to each other. Should the upper layout become worn or soiled, it could simply be replaced in the manner described above by one of the other game layout pads. Again, this can be done without having to move the table off the gaming floor and with substantially little or no down time.

The present invention may be embodied in other specific forms without departing from the spirit or essential attributes thereof and accordingly, reference should be made to the appended claims rather than to the foregoing specification as indicating the scope of the invention.

I claim:

1. A casino gaming table with interchangeable layouts comprising:

a table base;

a planar tabletop supported on said table base, said tabletop having an upper surface and a peripheral edge, a portion of said peripheral edge being arcuately shaped and a portion of said peripheral edge being linear, said table including a wall adjacent a portion of said linear peripheral edge that extends upwardly above the upper surface of said tabletop, said wall being moveable from an operable position wherein it extends vertically above said upper surface to an inoperative position wherein it is below said surface;

an arcuately shaped rail mounted to said tabletop adjacent said arcuately shaped peripheral edge, said rail having a lower surface overlying a portion of said upper surface of said tabletop but being spaced therefrom by a fixed distance thereby leaving a space between said lower surface of said rail and said upper surface of said tabletop;

a plurality of game layout pads each of which has an arcuate peripheral edge and each of which has a linear peripheral edge that is complementary to said linear edge of said tabletop, each of said layout pads including a surface with game indicia printed thereon, the thickness of each of said layout pads being less that half of said fixed distance;

said plurality of layout pads lying on said planar tabletop, the arcuate peripheral edges of said layout pads lying in said space between said lower surface of said rail and said upper surface of said tabletop.

2. The casino gaming table with interchangeable layouts as claimed in claim 1 wherein the indicia on each of said game layout pads is different from the indicia on the other of said game layout pads whereby each pad represents a different game.

3. The casino gaming table with interchangeable layouts as claimed in claim 1 wherein said plurality of layout pads is comprised of at least three.

4. The casino gaming table with interchangeable layouts as claimed in claim 1 wherein said game layout pads are rigid enough to substantially maintain their planar shape when being moved into and out of position but which can be flexed in order to insert the arcuate peripheral edges thereof into said space between said lower surface of said rail and said upper surface of said tabletop.

* * * * *